US005731559A

United States Patent [19]

Daccord

[11] Patent Number: 5,731,559

[45] Date of Patent: Mar. 24, 1998

[54] SWITCH MECHANISM

[75] Inventor: Marcel Daccord, Condat, France

[73] Assignees: Legrand; Legrand SNC, both of Limoges, France

[21] Appl. No.: 746,487

[22] Filed: Nov. 12, 1996

[51] Int. Cl.[6] ..... H01H 15/00

[52] U.S. Cl. ..... 200/16 R; 200/242

[58] Field of Search ..... 200/4, 6 R–6 C, 200/16 R, 16 C, 16 D, 553, 564, 557–559, 241, 242, 252, 253, 275, 339

[56] References Cited

U.S. PATENT DOCUMENTS

| | | | |
|---|---|---|---|
| 3,200,212 | 8/1965 | Barcus et al. | 200/61.34 |
| 3,479,478 | 11/1969 | Robbins | 200/153 |
| 3,527,913 | 9/1970 | Gionet | 200/153 |
| 3,591,747 | 7/1971 | Dennison | 200/153 |
| 4,556,765 | 12/1985 | Shaw et al. | 200/61.71 |
| 4,843,200 | 6/1989 | Parlatore et al. | 200/553 |
| 5,568,860 | 10/1996 | Stringwell et al. | 200/242 |

FOREIGN PATENT DOCUMENTS

| | | | |
|---|---|---|---|
| 0268518 | 5/1988 | European Pat. Off. | H01H 23/12 |
| 2061974 | 7/1971 | Germany | H01H 23/24 |
| 468510 | 1/1952 | Italy . | |

*Primary Examiner*—Cassandra C. Spyrou
*Assistant Examiner*—Michael A. Friedhofer
*Attorney, Agent, or Firm*—Young & Thompson

[57] ABSTRACT

A switch mechanism has a conductive mobile contact carrier with two lateral branches pivotally engaged with a central hub. The lateral branches of the conductive mobile contact carrier are continuous with its middle branch, each being joined to the latter by a large radius elbow, and the conductive mobile contact carrier bears on the output contacts through its lateral branches. The output contacts are near the central hub so that the lateral branches of the conductive mobile contact carrier are subjected to a local transverse self-cleaning movement when it comes into contact with the output contact. Applications include single-throw and double-throw switches.

10 Claims, 2 Drawing Sheets

SWITCH MECHANISM

BACKGROUND OF THE INVENTION

1. Field of the Invention

The present invention is generally concerned with switch mechanisms of the kind including, on the one hand, at least two fixed contacts, namely, for example, an input contact and at least one output contact each electrically connected to a respective connection terminal, and, on the other hand, a conductive mobile contact carrier that is electrically connected to the input contact and which, under the control of an actuator, is mobile between two positions, namely a position in which it bears on the output contact and a position in which it is separated from the latter.

It may be a single-throw switch, for example, in which case there is only one output contact, the conductive mobile contact carrier resting at best on a simple rest stud when it is separated from the output contact.

Alternatively, it may be a double-throw switch, in which case there are two output contacts, the conductive mobile contact carrier bearing alternately on them according to its position.

2. Description of the Prior Art

An output switch mechanism of this kind is described in U.S. Pat. No. 4,843,200.

In one of the embodiments described in the above patent, the conductive mobile contact carrier has two lateral branches continuous with a middle branch and is in the form of a closed loop on the input contact, being articulated to the input contact at two opposite points of the latter.

This arrangement has given satisfaction and may continue to do so.

It has the following drawbacks, however.

First of all, the articulations by which the conductive mobile contact carrier is engaged with the input contact, which are in practise knife-edge type articulations, must assure a two-fold function, namely pivotal mounting and transmission of electric current.

As the transmission of electric current is effected merely by contact, it is not rare for undesirable overheating to occur at this point.

To improve the corresponding contact conditions it is usual practise to bury the area concerned in a mass of grease, among other things to prevent oxidation of metal components in this area, at the cost of an additional operation in the assembly of the device.

What is more, the number of separate metal components used in the construction of a switch mechanism of this kind is relatively large.

Finally, the articulations of the conductive mobile contact carrier being on a fixed component, in this case the input contact, it comes into contact with and separates from the output contact in a normal direction, without the benefit of any transverse movement relative to the axis of the latter either on closing or on opening.

This drawback is accentuated by the fact that the conductive mobile contact carrier in practise bears on the output contact through one of its lateral branches, near the input contact, and this lateral branch is straight or substantially straight between the output contact and the input contact, being curved, if at all, only at the end where it is articulated to the input contact.

In Italian patent 468 510 the middle branch of the conductive mobile contact carrier if fastened (in practise screwed) to the input contact, which normally avoids the need to use grease in the corresponding area.

However, in the above Italian patent, the lateral branches of the conductive mobile contact carrier extends parallel to its middle branch, on either side of the latter, bending back a cross member which the middle branch also bends back, these lateral branches being pivotally engaged at diametrally opposite positions with a central hub which, itself pivoting under the control of the actuators, causes the conductive mobile contact carrier to move from one of its positions to the other.

Apart from the fact that the conductive mobile contact carrier constitutes a relatively complex and bulky component, to the detriment of overall compactness, as before it can only come into contact with and separate from the output contact in a normal direction, without any local transverse movement relative to the axis of the latter.

In U.S. Pat. No. 3,527,913 the lateral branches of the conductive mobile contact carrier extend freely, without any engagement with a hub.

This applies equally to German patent application 2 061 974.

A general object of the present invention is to provide an arrangement which, whilst benefiting from the use of a hub, has the advantage of encouraging a controlled transverse movement of the conductive mobile contact carrier relative to the contacts, with the benefit of self-cleaning or wiping of the contacts in service, and which leads to further advantages.

SUMMARY OF THE INVENTION

To be more precise, the present invention consists in a switch mechanism of the kind including, on the one hand, at least two fixed contacts, namely, for example, an input contact and at least one output contact each electrically connected to a respective connecting terminal, and, on the other hand, a conductive mobile contact carrier that has a middle branch fastened to the input contact and two lateral branches pivotally engaged proximate the respective free distal ends thereof with a central hub at diametrally opposite positions thereon, said central hub being mounted to pivot under the control of an actuator between two positions, namely a position in which said conductive mobile contact carrier bears on said output contact and a position in which it is separated therefrom, wherein said lateral branches of said conductive mobile contact carrier are continuous with its middle branch, each being joined to the latter by a large radius elbow, said conductive mobile contact carrier is adapted to bear on said output contact through one of its lateral branches, and said output contact is near said central hub so that said lateral branch of said conductive mobile contact carrier is subjected to a local transverse self-cleaning movement when it comes into contact with said output contact.

The lateral branch tracks the central hub at this level, and because the path of the latter is circular, it follows a path having a transverse component relative to the axis of the output contact.

There is nothing like this, and there could not be anything like this, in either of the two documents analyzed briefly hereinabove.

Further, should the conductive mobile contact carrier stick to the output contact, systematic unsticking is advantageously assured; because the output contact is near the central hub, the clearances and the elasticity are limited at this level and prevent actuation of the actuator without effective unsticking of the conductive mobile contact carrier.

Furthermore, because the elasticity is of little effect at this level, the conductive mobile contact carrier is advantageously brought sharply into contact with the output contact, which has the advantage of limiting any contact bounce.

The features and advantages of the invention will emerge from the following description given by way of example with reference to the accompanying diagrammatic drawings.

DETAILED DESCRIPTION OF THE PREFERRED EMBODIMENTS

As shown in the figures, and in a manner that is known in itself, the switch mechanism 10 of the invention includes, firstly, at least two fixed contacts 11A, 11B, namely, for example, a first or input contact 11A and at least one second or output contact 11B which are electrically connected to respective connection terminals 12A, 12B and, on the other hand, a conductive mobile contact carrier 13 of generally open loop configuration that is electrically connected to the input contact 11A and which, under the control of an actuator accessible to the user, is adapted alternately to bear on the output contact 11B and to be separated from the latter.

For simplicity the actuator accessible to the user is not shown in the figures.

Figure 1:
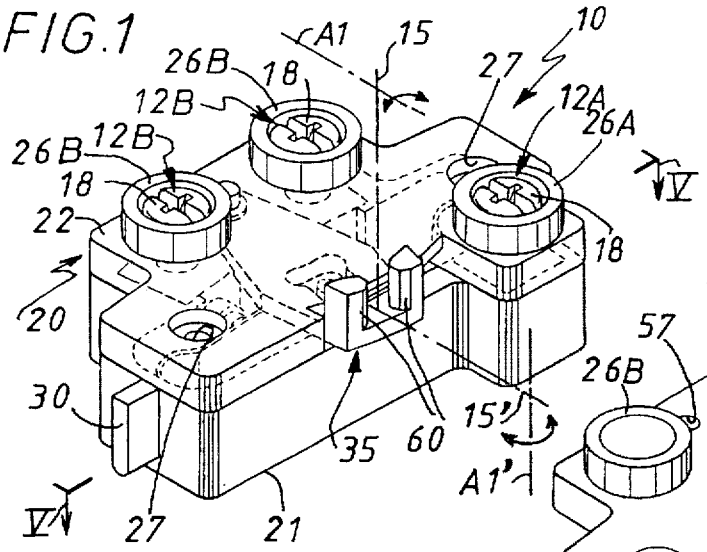
FIG. 1 is a perspective view of a switch mechanism of the invention.

It is schematically shown in dashed outline (15 or 15') in FIG. 1, however.

It is in practise a key pivoting about an axis $A_1$ or $A'_1$ in one or other of two mutually orthogonal orientations.

In the embodiment shown, the switch mechanism 10 of the invention includes two spaced output contacts 11B against which the conductive mobile contact carrier 13 bears alternately.

This embodiment of the switch mechanism 10 of the invention therefore has three connecting terminals, namely one connection terminal 12A and two connection terminals 12B.

The connection terminals 12A, 12B are identical.

In practise they are screw terminals, i.e. connection terminals in the form of a block 16 with a hole 17 in it to receive an electrical conductor and a screw 18 that screws into a screwthreaded hole 19 orthogonal to the first hole 17.

The combination is housed in a casing 20 which in the embodiment shown is cassette-shaped and comprises a body 21 and a cover 22.

The body 21 incorporates compartments 24A, 24B to receive the connecting terminals 12A, 12B and each of which communicates with the exterior through an opening 25A, 25B in line with the hole 17 in the block 16 of the corresponding connecting terminal 12A, 12B.

The cover 22 includes wells 26A, 26B in line with the compartment 24A, 24B of the body 21 to provide access to the screws 18 of the connecting terminals 12A, 12B.

The cover 22 is fastened to the body 21 by means of screws, for example (not shown).

To this end, in the embodiment shown the cover 22 has two spaced holes 27 respectively in line with two wells 28 in corresponding relationship in the body 21, projecting from the bottom 29 of the latter.

In the embodiment shown the body 21 of the casing 20 also has on the outside two projecting lugs 30 which extend generally back-to-back, aligned with each other, to facilitate its retention and immobilization in any form of housing, for example.

Figure 5:
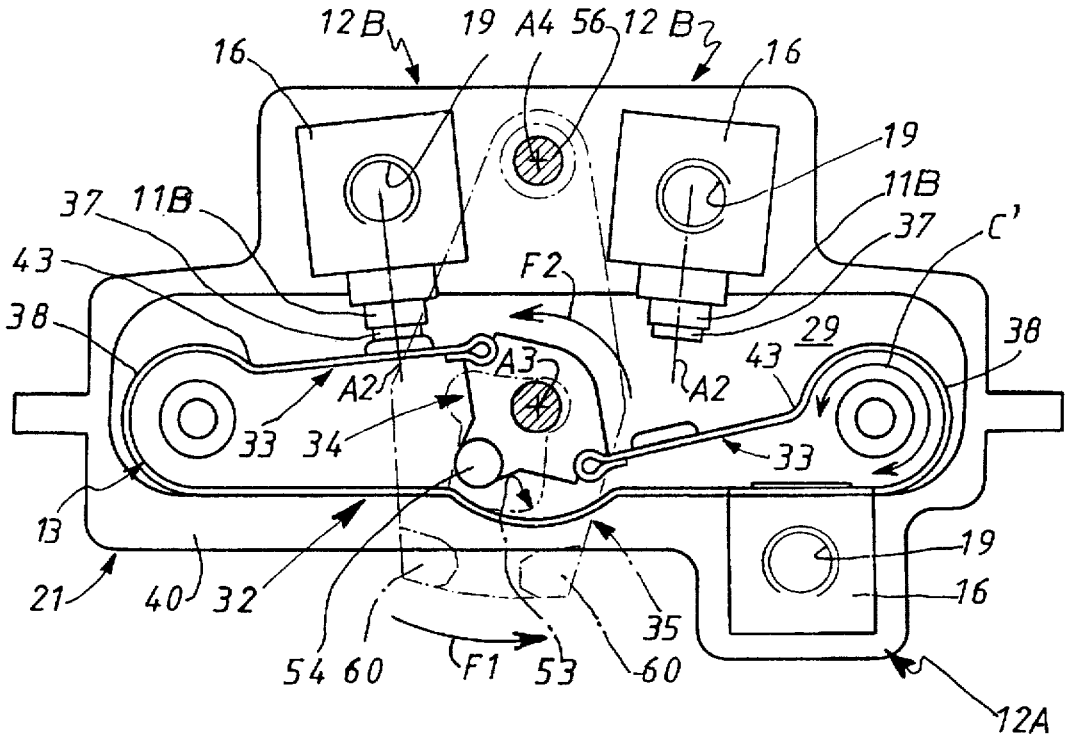
FIG. 5 is a plan view of the switch mechanism of the invention to a larger scale and in section on the line V—V in FIG. 1, for one position of the conductive mobile contact carrier.
Figure 6:
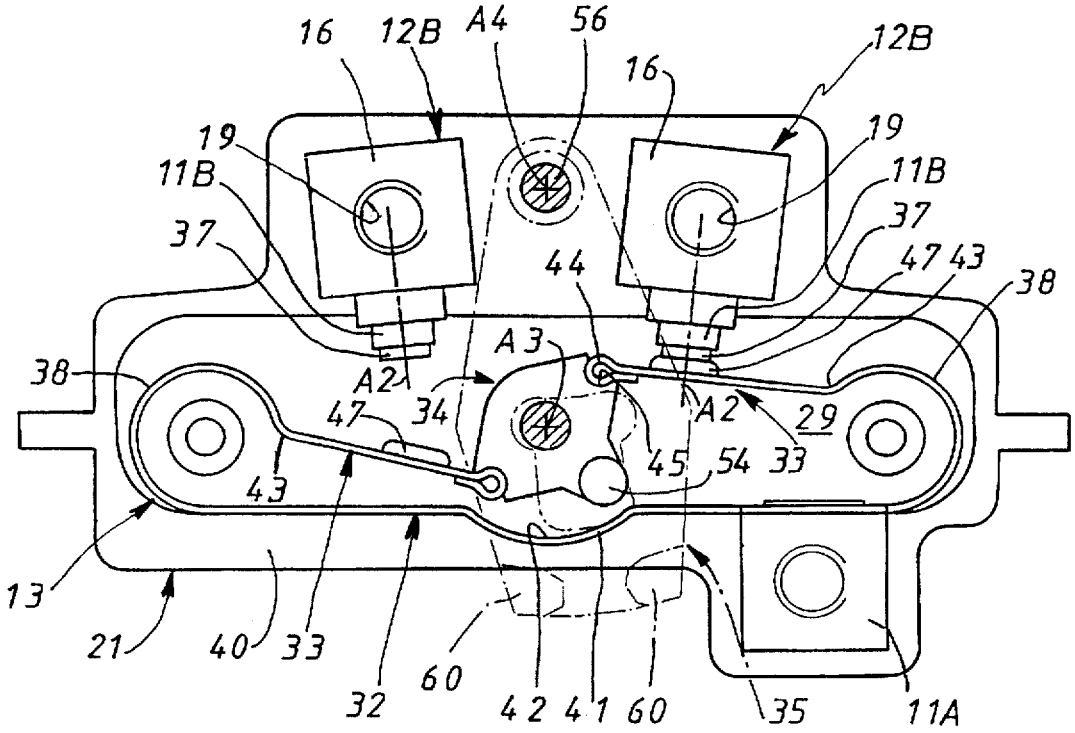
FIG. 6 is a sectioned plan view similar to that of FIG. 5, for the other position of the conductive mobile contact carrier.

In a manner that is known in itself, the conductive mobile contact carrier 13 has a middle branch 32 by which it is fastened to the input contact 11A and two lateral branches 33 which extend generally towards each other and which are pivotally engaged with a central hub 34 at diametrally opposite positions, in a manner to be described in more detail below, the central hub 34 being mounted to pivot in the casing 20 under the control of an actuator 35 between two positions, namely a position in which the conductive mobile contact carrier 13 bears on one of the output contacts 11B, as shown in FIG. 5, and a position in which it is separated from this output contact 11B and bears on the other output contact 11B, as shown in FIG. 6.

In the embodiment shown the input contact 11A is in practise formed directly by the corresponding connecting terminal 12A, to be more precise by the block 16 of the latter.

The conductive mobile contact carrier 13 is therefore directly fastened to this block 16.

Figure 3:
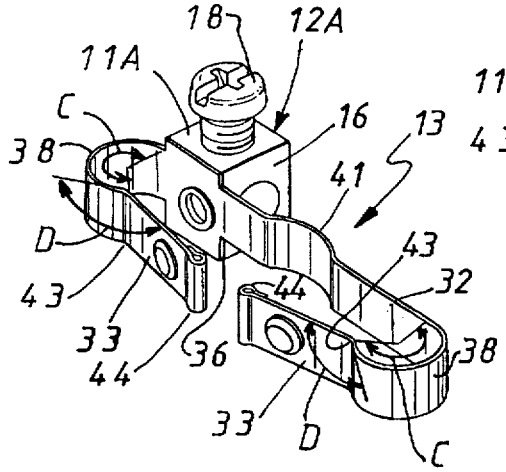
FIG. 3 is a perspective view of the conductive mobile contact carrier of the switch mechanism and the input contact to which the conductive mobile contact carrier is fastened, in a different orientation.
Figure 3:
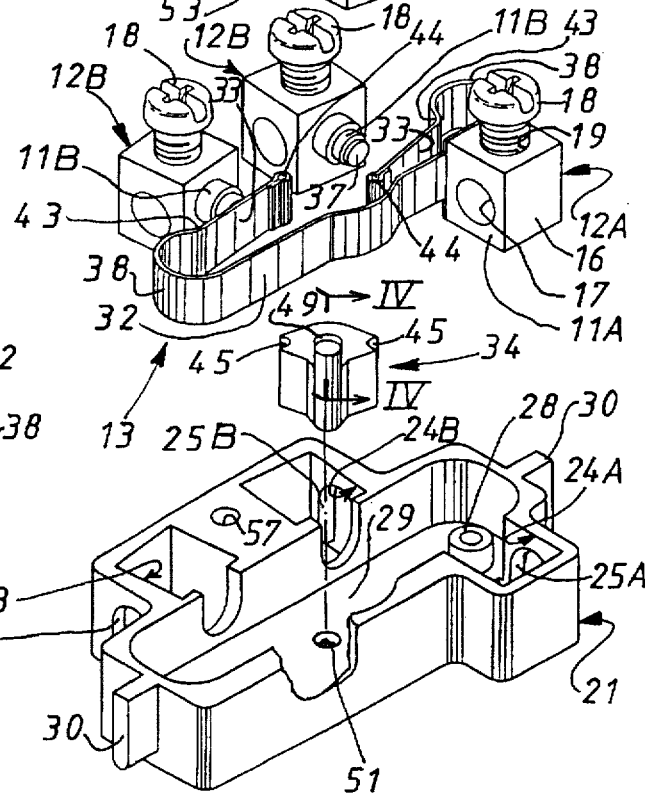
Figure 4:
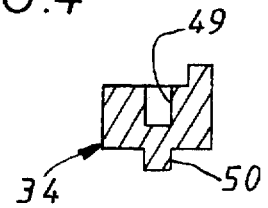
FIG. 4 is a view of the central hub with which the lateral branches of the conductive mobile contact carrier are pivotally engaged in axial section on the line IV—IV in FIG. 2.

As shown here, an enlargement 36 of its middle branch 32 is crimped to the block 16, for example (FIG. 3).

The output contacts 11B are formed by bosses projecting from the block 16 of the corresponding connecting terminals 12B.

In the embodiment shown the output contacts 11B each carry on their surface a contact bead 37.

In accordance with the invention the lateral branches 33 of the conductive mobile contact carrier 13 are continuous with its middle branch 32, each joining the latter through a large radius elbow 38, the conductive mobile contact carrier 13 is adapted to bear on one or other of the output contacts 11B through one or other of its lateral branches 33, and both the output contacts 11B are near the central hub 34 so that, for each lateral branch 33, as will emerge below, the conductive mobile contact carrier 13 is subject to a local self-cleaning transverse movement when it comes into contact with an output contact 11B.

In the present context a transverse movement is a movement substantially perpendicular to the axis $A_2$ of the output contact 11B concerned, this axis $A_2$ being globally defined by the direction in which the contact projects from the block 16 of the corresponding connection terminal 12B.

The conductive mobile contact carrier 13 is in practise in one piece, comprising a metal strip appropriately cut and bent to shape.

In practise it is elastically deformable.

The conductive mobile contact carrier 13 forms a closed loop on the central hub 34.

Its middle branch 32 bears against a wall 40 of the body 21 of the casing 20.

To enable the central hub 34 to move, the generally rectilinear middle branch 32 has a curved middle portion 41 extending substantially along a circular arc with its concave side facing towards the lateral branches 33 and engaged in a complementary notch 42 in the wall 40 of the body 21 of the casing 20.

Accordingly, the input contact 11A is in an eccentric position relative to the central hub 34.

In other words, the input contact 11A is nearer one of the lateral branches 33 of the conductive mobile contact carrier 13 than the other.

As shown here, the elbow 38 through which each of the lateral branches 33 of the conductive mobile contact carrier 13 is joined to its middle branch 32 preferably subtends an angle at the center C which, at rest, as shown in FIG. 3, is greater than 180°, one arm of the elbow 38 being continuous with the middle branch 32 while the other forms with the lateral branch 33 concerned a dihedron D subtending a large angle and the concave side of which faces away from the middle branch 32.

In other words, each lateral branch 33 has a bend 43 where it joins onto the adjoining elbow 38.

Conjointly, the output contacts 11B and therefore the blocks 16 of the connecting terminals 12B that carry them are slightly oblique to the middle branch 32 of the conductive mobile contact carrier 13, converging in the direction towards the middle branch 32.

In other words, and as can be seen more clearly in FIGS. 5 and 6, their axes $A_2$ converge towards the middle branch 32.

As shown here, each lateral branch 33 of the conductive mobile contact carrier 13 is preferably engaged with the central hub 34 through a bead 44 having a rounded cross-section, the central hub 34 including a complementary rounded cross-section groove 45.

In the embodiment shown, the bead 44 of the lateral branches 33 of the conductive mobile contact carrier 13 is in practise formed by bending the end of the latter back on itself.

The lateral branches 33 of the conductive mobile contact carrier 13 are in practise each equipped with a projecting contact bead 47 adapted to bear on the output contacts 11B, to be more precise on the contact bead 37 carried by the latter.

As shown diagrammatically by its position in FIGS. 5 and 6, the axis $A_3$ of the central hub 34, which is of course parallel to the transverse direction of the strip constituting the conductive mobile contact carrier 13, is perpendicular to the bottom 29 of the body 21 of the casing 20.

Figure 2:
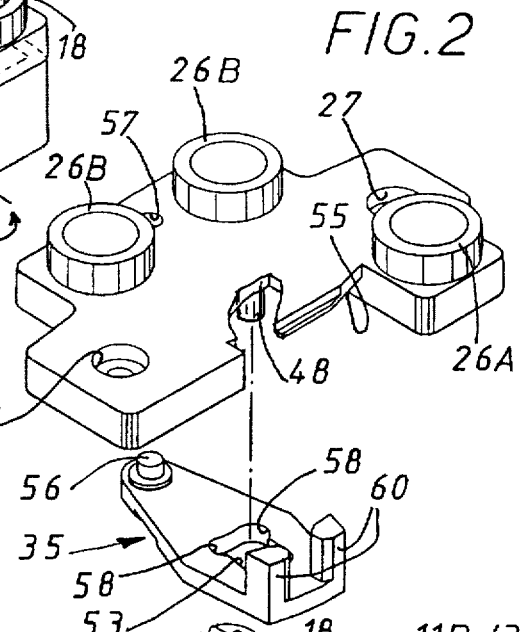
FIG. 2 is an exploded partly cut away perspective view of this switch mechanism.

In the embodiment shown this pivot axis $A_3$ is in practise materialized, on the one hand, by a stub axle 48 projecting cantilever fashion from the interior surface of the cover 22 of the casing 20, as can be seen in FIG. 2, and adapted to be rotatably engaged in a blind bore 49 formed for this purpose in the central hub 34 and, on the other hand, by a journal 50 projecting from the opposite face of the central hub 34, in line with the blind bore 49 previously mentioned, and adapted to be rotatably engaged in a recessed blind housing 51 provided for this purpose on the bottom 29 of the body 21 of the casing 20, as can also be seen in FIG. 2.

The grooves 45 on the central hub 34 are of course parallel to its pivot axis $A_3$.

The grooves 45 lie generally back-to-back at respective ends of two relatively narrow parts of the central hub 34.

In the embodiment shown the actuator 35 of the central hub 34 is a swing-arm that is mounted to pivot about an axis $A_4$ parallel to and spaced from the pivot axis $A_3$ of the central hub 34 and incorporating an opening 53 which is engaged with clearance over a lug 54 projecting to this end from the latter.

The actuator 35 is in the general form of a flat plate inserted between the body 21 of the casing 20 and the cover 22 of the latter, occupying a recess 55 provided for this purpose on the interior surface of the cover 22. To allow action of the actuator member 15 or 15' accessible to the user, it projects out of the assembly at the end opposite its pivot axis $A_4$.

The pivot axis $A_4$ of the actuator 35 is in practise defined by two journals 56, one of which can be seen in FIG. 2, projecting back-to-back from the two opposite faces of the actuator 35 and each rotatably engaged with a respective bore 57 in corresponding relationship, one on the body 21 of the casing 20 between the compartments 24B and the other on the cover 22 between the wells 26B.

The opening 53 of the actuator 35 is also engaged over the stub axle 48 and, to prevent it interfering with the latter, the opening 53 has two side lobes 58.

The swing-arm forming the actuator 35 has two parallel lugs 60 projecting out of the casing 20 and between which the actuator member 15 or 15' accessible to the user can engage.

These lugs 60 are in practise parallel to the pivot axis $A_4$ of the actuator 35 and, similarly, the stud 54 on the central hub 34 is parallel to its pivot axis $A_3$.

At rest, one lateral branch 33 of the conductive mobile contact carrier 13 bears on one of the output contacts 11B, the lefthand output contact, for example, as shown in FIG. 5, and therefore electrically connects the input contact 11A to the output contact 11B.

For the corresponding overall configuration of the conductive mobile contact carrier 13, the elbow 38 corresponding to the lateral branch 33 concerned of the latter is the subject of light torsional elastic stressing.

The elbow 38 associated with the other lateral branch 33 of the conductive mobile contact carrier 13 is the subject of significantly higher torsional elastic stressing, which causes it to close up on itself with an angle C' at the center significantly greater than the angle C at the center when at rest.

When the actuator member 15 or 15' accessible to the user is operated the actuator 35 is constrained to move from one of its positions to the other by rotating about its pivot axis $A_4$, as shown diagrammatically by the arrow F1 in FIG. 5, the central hub 34 being itself constrained to move from one position to the other by rotation about its pivot axis $A_3$, as shown diagrammatically by the arrow F2 in FIG. 5.

During the rotation of the central hub 34, the lateral branch 33 of the conductive mobile contacts carrier 13 that was in bearing engagement against one of the output contacts 11B is constrained to separate from the latter while the other, which was previously separated from the other output contact 11B, is constrained to move towards the latter, until it in turn bears against the latter, as shown in FIG. 6.

In doing this, however, both lateral branches 33 of the conductive mobile contact carrier 13 are initially pressed more strongly against the central hub 34 and this causes temporary relative elastic unrolling of the adjoining elbow bends 38.

This continues until they suddenly move past a top dead center configuration corresponding to the moment at which they are substantially aligned with each other.

The lateral branch 33 initially separated from one output contact 11B then comes suddenly into bearing engagement with the latter, as shown for the lateral branch 33 on the righthand side in FIG. 6.

It is thereafter to this output contact 11B that the input contact 11A is electrically connected by the conductive mobile contact carrier 13, while the other lateral branch 33 of the latter and the other output contact 11B are separated from each other.

In a case of this kind the switch mechanism 10 of the invention operates as a double-throw switch.

As previously indicated, however, it can also operate as a single-throw switch if a simple rest stud is substituted for one of the output contacts 11B, for example.

Be this as it may, in the ultimate phase of its movement towards an output contact 11B, each lateral branch 33 of the conductive mobile contact carrier 13 is the subject of a circular movement which is deduced from that of the bead 44 through which it is engaged with the central hub 34 and which has, relative to the output contact 11B and, to be more precise, relative to the contact bead 37 carried by the latter, a transverse component causing self-cleaning of the contact bead 37 as well as of its own contact bead 47.

The same applies when a lateral branch 33 separates from the output contact 11B against which it was previously bearing.

Of course, the present invention is not limited to the embodiment described and shown, but encompasses any variant execution thereof.

There is claimed:

1. Switch mechanism comprising at least first and second fixed contacts connected to respective connecting terminals and a conductive mobile contact carrier of generally open loop configuration including a middle branch fastened to the first contact and two lateral branches in pivotal engagement with a central hub at diametrically opposed positions thereon, end portions of said lateral branches including respective beads of rounded cross-section, said central hub having grooves of complementary rounded cross-section for respectively receiving said end portions, an actuator for controlling rocking movement of said central hub between a first, contact position in which said conductive mobile contact carrier is in electrical conducting engagement with the second fixed contact and a second, out-of-contact position in which said conductive mobile contact carrier is out of electrical conducting engagement with said second fixed contact, said lateral branches being continuity with said middle branch and each of said lateral branches being joined to said middle branch by a large radius elbow, a contact area on one of said lateral branches being located near said hub, whereby said contact area is subjected to local transverse self-cleaning movement when it comes into contact with said second fixed contact.

2. The switch mechanism claimed in claim 1, wherein said end portions of said lateral branches are defined by a folded over portions of the respective lateral branches.

3. Switch mechanism comprising at least first and second fixed contacts connected to respective connecting terminals and a conductive mobile contact carrier of generally open loop configuration including a middle branch fastened to the first contact and two lateral branches with free distal ends extending generally towards each other, said lateral branches defining the open side of the loop, said lateral branches being in pivotal engagement, proximate to the distal ends, with a central hub at diametrically opposed positions thereon, an actuator for controlling rocking movement of said central hub between a first, contact position in which said conductive mobile contact carrier is in electrical conducting engagement with the second fixed contact and a second, out-of-contact position in which said conductive mobile contact carrier is out of electrical conducting engagement with said second fixed contact, said lateral branches being in continuity with said middle branch and each of said lateral branches being joined to said middle branch by a large radius elbow, a contact area on at least one of said lateral branched being located near one of the free distal ends thereof, whereby said contact area is subjected to local transverse self-cleaning movement as it engages said second fixed contact.

4. The switch mechanism claimed in claim 3, wherein each of said elbows subtends an angle at the center greater than 180°, one extremity of the elbow being connected to middle branch and the other extremity of each of said elbows forming with the respective lateral branch an obtuse dihedral angle having a concave surface facing outwardly of the loop.

5. The switch mechanism claimed in claim 3, wherein said first fixed contact is located nearer one of said lateral branches than the other of said lateral branches.

6. The switch mechanism claimed in claim 3, wherein said actuator comprises a rocker arm mounted for pivotal movement about an axis parallel to the pivot axis of said central hub, said rocker arm including an opening received with clearance around a stud projecting from said central hub.

7. The switch mechanism claimed in claim 6, wherein said rocker arm has two parallel projecting lugs engageable around an operating member accessible to a user.

8. The switch mechanism claimed in claim 3, wherein said contact area includes a projecting contact engageable with said second fixed contact.

9. The switch mechanism claimed in claim 3, wherein said second fixed contact is oblique relative to said middle branch.

10. The switch mechanism claimed in claim 3, wherein there are two spaced second contacts and said contact area on each of the respective lateral branches cooperable therewith, said contact areas being respectively alternately engagebly with the respective second fixed contact.

* * * * *